United States Patent [19]

Fukuda et al.

[11] 4,232,101

[45] Nov. 4, 1980

[54] PHOTOSENSITIVE PAPER FOR ELECTROPHOTOGRAPHY WITH AN ELECTRICALLY CONDUCTIVE COATING OF A FLUORINE RESIN

[75] Inventors: Hideo Fukuda, Katano; Hiroichi Morikawa, Osaka; Yasutoki Kamezawa, Kyoto; Tatsuo Aizawa, Osaka, all of Japan

[73] Assignee: Mita Industrial Company Ltd., Osaka, Japan

[21] Appl. No.: 919,674

[22] Filed: Jun. 27, 1978

[30] Foreign Application Priority Data

Jan. 9, 1978 [JP] Japan ..... 53-528

[51] Int. Cl.[2] ..... G03G 5/10

[52] U.S. Cl. ..... 430/56; 162/138; 428/537

[58] Field of Search ..... 96/1.5, 1.8; 162/138; 428/421, 537; 430/56, 69

[56] References Cited

U.S. PATENT DOCUMENTS

| | | | |
|---|---|---|---|
| 3,617,265 | 11/1971 | Petruzzella | 96/1.5 |
| 3,850,631 | 11/1974 | Tamai | 96/1.8 |
| 3,950,169 | 4/1976 | Timmerman | 96/1.8 |
| 4,037,017 | 7/1977 | Maslanka | 96/1.5 |
| 4,061,601 | 12/1977 | Clary et al. | 428/421 |

*Primary Examiner*—Roland E. Martin, Jr.
*Assistant Examiner*—John L. Goodrow
*Attorney, Agent, or Firm*—Sherman & Shalloway

[57] ABSTRACT

A photosensitive paper for electrophotography comprising a paper substrate, an electrophotographic photosensitive layer formed on one surface of the substrate and an electrically conductive coating layer formed on the other surface of the substrate, which electrically conductive coating layer comprises an electrically conductive binder medium and a fine powder of a fluorine resin distributed predominantly in the surface portion of the electrically conductive coating layer, is disclosed.

This photosensitive paper is satisfactory in all of the following properties; adaptability to the paper feeding operation, the scratch resistance of the photosensitive layer, the blocking resistance and electric characteristics irrespective of the humidity conditions in the operation atmosphere.

10 Claims, 1 Drawing Figure

PHOTOSENSITIVE PAPER FOR ELECTROPHOTOGRAPHY WITH AN ELECTRICALLY CONDUCTIVE COATING OF A FLUORINE RESIN

BACKGROUND OF THE INVENTION (1) Field of the Invention

This invention relates to a photosensitive paper for electrophotography. More particularly, the invention relates to a photosensitive paper for electrophotography which is excellent in the blocking resistance, the adaptability to the paper feeding operation, the scratch resistance in the photosensitive layer and electric characteristics irrespective of humidity conditions in the operation atmosphere.

(2) Description of the Prior Art

Photosensitive papers broadly used for electrophotography comprise a paper substrate, an electrophotographic photosensitive layer formed on one surface of the substrate and an electrically conductive coating layer formed on the other surface of the substrate. For formation of the electrically conductive layer, there has been used a binder medium containing an inorganic or organic conducting agent incorporated therein (which will be hereinafter referred to as "electrically conductive binder medium"). As the conducting agent, there are used cationic, anionic and nonionic conductive resins, water-soluble inorganic salts, and water-soluble or moisture-absorbing, organic low-molecular-weight compounds. In each of these conventional electrically conductive binder media, a necessary electric conductivity is attained by maintaining an appropriate moisture content in the medium. Accordingly, photosensitive papers prepared by using these electrically conductive binder media have a very high moisture-absorbing property, and since also binder media per se are water-soluble, the blocking tendency (tacking phenomenon) is very conspicuous in the photosensitive papers. Further, the tendency of the photosensitive papers to curl becomes conspicuous when the humidity changes.

As means for eliminating the foregoing defects of photosensitive papers for electrophotography and providing good slip properties between photosensitive papers to improve the adaptability to the paper feed operation, there has been proposed and is known a method in which a slip improving agent is incorporated in an electrically conductive binder medium.

As typical instances of such slip improving agent, there can be mentioned white solid powders of talc, active clay, diatomaceous earth, silica, titanium dioxide and magnesia. However, if such white solid powder is incorporated into an electrically conductive binder medium in an amount sufficient to attain a significant improvement of the slip characteristic, electrophotographic photosensitive layers of the resulting photosensitive papers are readily scratched by frictional contacts between back and front surfaces of the piled photosensitive papers, especially by mutual friction at the paper feeding step, and if these scratches are formed, areas of the scratches are developed to cause contamination of the background. Further, the smoothness of the coated surface of the photosensitive paper is degraded because of the presence of a large quantity of the white solid powder. Still further, such white solid powder is very sensitive to the humidity and it has a property of adsorbing the moisture-absorbing substance contained in the electrically conductive binder medium. Accordingly, the slip characteristic changes depending on the change of the humidity, and the stability of the paper feeding operation is degraded. Still in addition, the electric conductivity of the electrically conductive coating layer of the photosensitive paper is drastically changed according to the change of the humidity, resulting in changes of various characteristics of a copied image.

As another type of the slip improving agent, there are known various waxes, higher fatty acids such as stearic acid and palmitic acid, derivatives of these higher fatty acids, olefin resins such as low-molecular-weight polyethylene and polypropylene, polyalkylene polyols such as high-molecular-weight polyethylene glycol, and silicones, and these organic slip improving agents have been incorporated in electrically conductive binder media such as mentioned above. However, these slip improving agents are still insufficient in preventing occurrence of the blocking (tacking) phenomenon among photosensitive papers, and especially under high humidity conditions, the efficiency of the paper feeding operation is reduced by the tacking phenomenon of photosensitive papers. Still further, in case of photosensitive papers prepared by using such slip improving agent, it is difficult to make air present between two piled photosensitive papers, and therefore, it is often difficult to feed photosensitive papers one by one smoothly and stably. Moreover, when such slip improving agent is employed, the surface smoothness is excessively heightened and there is caused a defect that such properties as the touch and graphic property are degraded.

As will readily be understood from the foregoing illustration, there has not been known a photosensitive paper for electrophotography which is satisfactory in all of the adaptability to the paper feeding operation, the scratch resistance of the photosensitive layer, the blocking resistance and electric characteristics.

BRIEF SUMMARY OF THE INVENTION

We found that when a fluorine resin powder is incorporated in a coating composition for formation of an electrically conductive binder medium and this composition is coated and dried on a paper substrate to form an electrically conductive coating layer, the fluorine resin is predominantly distributed in the surface portion of the electrically conductive coating layer and particles of the fluorine resin act as slip rollers, and as a result, there can be obtained a photosensitive paper for electrophotography excellent in the adaptability to the paper feeding operation, the scratch resistance of the photosensitive layer, the blocking resistance and electric characteristics. We have now completed this invention based on this finding.

More specifically, in accordance with the present invention, there is provided a photosensitive paper for electrophotography which comprises a paper substrate, an electrophotographic photosensitive layer formed on one surface of the paper substrate and an electrically conductive coating layer formed on the other surface of the paper substrate, said electrically conductive coating layer comprising an electrically conductive binder medium and a fine powder of a fluorine resin distributed predominantly in the surface portion of said electrically conductive coating layer.

DETAILED DESCRIPTION OF THE INVENTION

Figure 1:
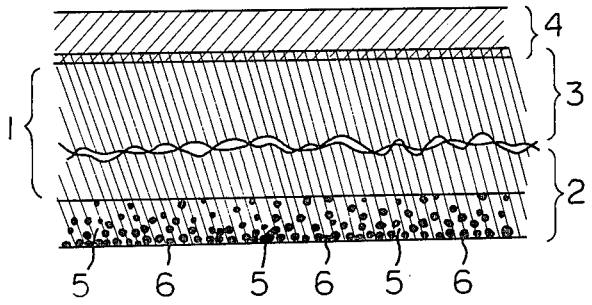
FIG. 1 is a diagram illustrating the section of one embodiment of a photosensitive paper for electrophotography according to this invention.

Referring to FIG. 1 diagrammatically illustrating the section of a photosensitive paper for electrophotography according to this invention, an electrically conductive coating layer 2 is formed as a back coat on the back surface of a paper substrate, and an electrophotographic photosensitive layer 4, i.e., a photoconductive layer, is formed on the front surface of the paper substrate 1, optionally through an undercoat layer 3.

It is one of important features of this invention that the electrically conductive coating layer 2 is composed of an electrically conductive binder medium 5 and a fine powder 6 of a fluorine resin and this fine powder of the fluorine resin is distributed predominantly in the surface portion of the electrically conductive coating layer 2.

It is known that fluorine resins have a lowest friction coefficient among various synthetic resins. This invention is based on the finding that when a fluorine resin is incorporated in the form of a fine powder into a coating composition for formation of an electrically conductive binder medium and the composition is coated and dried on a paper substrate 1, the fine powder of the fluorine resin is caused to rise on the electrically conductive binder medium because of non-affinity or incompatibility of the fluorine resin with the binder medium and there is manifested a multi-layer distribution structure including the fluorine resin distributed predominantly in the surface portion of the electrically conductive coating layer.

Fine particles of the fluorine resin present in the surface portion of the electrically conductive coating layer have a very low friction coefficient and act as slip rollers (projections) to the friction of the photosensitive paper. Accordingly, various properties such as the slip characteristic of the photosensitive paper are remarkably improved as described in detail hereinafter.

As pointed out above, fine particles of the fluorine resin present in the surface portion of the electrically conductive coating layer act as slip rollers and because of the presence of such slip rollers or projections, air is allowed to be present between two piled photosensitive papers. Accordingly, the tacking phenomenon is prevented in piled photosensitive papers, and a stable slip characteristic and a good adaptability to the paper feeding operation can be attained.

Further, fine particles of the fluorine resin present in the surface portion of the electrically conductive coating layer have a very low friction coefficient and have a very good slip characteristic, and they are softer than inorganic solid powders. Therefore, even if two piled photosensitive papers are rubbed on each other, the electrophotographic photosensitive layer is not damaged at all. Namely, the scratch resistance of the photosensitive layer is remarkably improved.

The fluorine resin distributed predominantly in the surface portion of the electrically conductive coating layer is not sensitive to the moisture or humidity, and further, fine particles of the fluorine resin acting as slip rollers prevent the entire or substantial surface of the electrically conductive binder medium from falling in contact with other substance. Therefore, a constant slip characteristic (a constant adaptability to the paper feeding operation) can be attained assuredly under either low humidity conditions or high humidity conditions. The tacking phenomenon can be effectively prevented even under high humidity conditions.

Still further, the fine powder of the fluorine resin is distributed predominantly in the surface portion of the electrically conductive coating layer and it is not substantially present in the electrically conductive binder medium permeating into or being present very close to the paper substrate. Furthermore, the fluorine resin has no property of adsorbing the conducting agent. Therefore, no substantial reduction of the electric conductivity is caused in the electrically conductive coating layer. In addition, the fluorine resin distributed in the surface portion of the electrically conductive layer acts as a barrier to migration of the moisture (absorption or desorption of the moisture). Therefore, even if the humidity in the atmosphere is changed, the variation of the electric conductivity of the coating layer can be maintained at a very low level.

Moreover, since fine particles of the fluorine resin, which does not have a moisture-absorbing property, are present in the surface portion of the electrically conductive coating layer, the curing resistance of the photosensitive paper can be remarkably improved and a photosensitive paper having a high nerve can be obtained.

It has been found that when a photosensitive paper for electrophotography according to this invention, which comprises a fine powder of a fluorine resin distributed predominantly in the surface portion of the electrically conductive coating layer, is used while setting it to a paper feed device of an actual copying machine, the following unexpected effect can be attained.

In a paper feed device of this type, sheet-like photosensitive papers are taken out one by one by paper feed rollers and are once stopped in a timing station. Then, they are fed along a photosensitive paper travelling passage to the respective treatment zones synchronously with scanning exposure of an original. Accordingly, when the slip characteristic of the photosensitive paper used is extremely high, in the timing station the photosensitive paper is stopped at a point deviated from the normal stopping position by bouncing from a stopper, and in the actual copying operation, there are caused such troubles as a shear of the top end of the image in printing. In contrast, in case of a photosensitive paper of this invention where a fine powder of a fluorine resin is present in the surface portion of the electrically conductive coating layer, by friction the fine powder of the fluorine resin is weakly charged to such an extent that the above-mentioned deviation of the stopping position is not caused, and therefore, in the actual operation, occurrence of the shear of the top end of the image in printing can be effectively prevented.

Any of known fluorine resins can be used in this invention. For example, there can be used polytetrafluoroethylene, tetrafluoroethylene/hexafluoropropylene copolymers, polytrifluoromonochloroethylene, polyvinyl fluoride, polyvinylidene fluoride, fluorinated rubbers, and copolymers thereof. Among these fluorine resins, polytetrafluoroethylene or trifluoromonochloroethylene is most preferred for attaining the objects of this invention.

The molecular weight of the fluorine resin is not particularly critical so far as solid fine particles can be formed. In general, however, fluorine resins having an average molecular weight (weight average molecular weight) of 10,000 to 300,000, especially 35,000 to 100,000, are preferably employed.

The particle size of the powder of the fluorine resin is not particularly critical so far as the above-mentioned action as the slip roller can be attained. In order to attain the objects of this invention, it generally is preferred to use a powder having a size of 0.5 to 10μ, especially 1 to 5μ.

The fluorine resin that is used in this invention is easily available in the form of a so-called dispersion, a lubricating or coating powder, a powder for formation of paints or inks or a molding powder.

Any of binder media that can be used for formation of electrically conductive coatings of photosensitive papers for electrophotography may be used as the electrically conductive binder medium in which the powdery fluorine resin is to be incorporated. For example, a resin which has an electric conductivity and a mixture of an ordinary binder resin and a conducting agent can be used.

As the electrically conductive resin, there can be used cationic, anionic and nonionic conductive resins and mixtures thereof. In order to control the electric resistance to a low level, it is preferred to use a cationic conductive resin having a quaternary ammonium group in the main chain or side chain. From the viewpoint of the electric conductivity, it is preferred that the concentration of the quaternary ammonium group in the resin be 200 to 1000 milliequivalents (meq)/100 g of the resin, especially 400 to 1000 meq/100 g of the resin.

As preferred examples of such cationic conductive resin, there can be mentioned the following resins.

(1) Resins having a quaternary ammonium group in the aliphatic main chain, such as quaternarized polyethyleneimines consisting of the following recurring units:

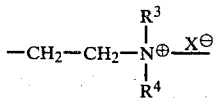

(1)

wherein $R^3$ and $R^4$ each stand for an alkyl group having up to 4 carbon atoms (hereinafter referred to as "lower alkyl group") such as a methyl group, and $X^{\ominus}$ stands for a monovalent, low-molecular-weight anion, and di-tertiary-amine/dihalide condensates, e.g., Ionene, (2) Resins having a quaternary ammonium group integrated with the cyclic main chain, such as polypyrazine, quaternarized polypiperazine, poly(dipyridyl), and 1,3-di-4-pyridylpropane/dihaloalkane condensates.

(3) Resins having a quaternary ammonium group in the side chain, such as polyvinyltrimethyl ammonium chloride and polyallyltrimethyl ammonium chloride.

(4) Resins having a quaternary ammonium group as a side chain on the cyclic main chain, such as resins consisting of the following recurring units:

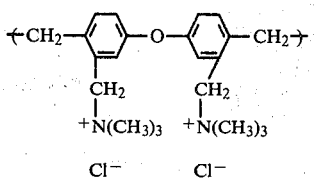

(2)

(5) Resins having a quaternary ammonium group in the cyclic side chain, such as poly(vinylbenzyltrimethyl ammonium chloride) and poly(p-vinylphenyltrimethyl ammonium chloride).

(6) Resins having a quaternary ammonium group as a side chain on the acrylic skeleton, such as polymers of quaternary acrylic esters, e.g., poly(2-acryloxyethyltrimethyl ammonium chloride) and poly(2-hydroxy-3-methacryloxypropyltrimethyl ammonium chloride), and polymers of quaternary acrylamides, e.g., poly(N-acrylamidopropyl-3-trimethyl ammonium chloride).

(7) Resins having a quaternary ammonium group in the heterocyclic side chain, such as poly(N-methylvinyl pyridinium chloride), poly(N-vinyl-2,3-dimethyl imidazolinium chloride) and poly(N-methylvinyl carbazolinium chloride).

(8) Resins having a quaternary ammonium group in the heterocyclic main chain, such as poly(N,N-dimethyl-3,5-methylene piperidinium chloride) and copolymers thereof.

Since cationic conductive resins that are used in this invention have a strong basicity owing to the quaternary ammonium group present in the main chain or side chain, they contain a monovalent, low-molecular-weight anion as the counter ion. The surface resistance of the cationic conductive resin is considerably influenced by the kind of this counter ion. As suitable examples of the counter ion, there can be mentioned, in the order of the importance, a chlorine ion, an acetic acid ion, a nitric acid ion and a bromide ion.

The above-mentioned cationic conductive resins (2), (5), (7) and (8), particularly resins consisting of the following recurring units:

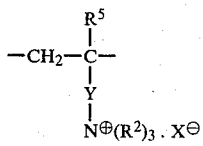

(3)

wherein $R^5$ stands for a hydrogen atom or a lower alkyl group, Y stands for a phenylene, phenylenemethylene or naphthylene group, $R^2$ stands for a lower alkyl group and $X^{\ominus}$ stands for a monovalent anion, and resins consisting of the following recurring units:

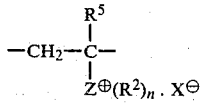

(4)

wherein $R^5$, $R^2$ and $X^{\ominus}$ are as defined above, Z is a divalent, nitrogen-containing heterocyclic group, especially a divalent group such as a residue of imidazoline, pyridine, quinoline, pyrazine or carbazole, n is zero, 1 or 2, and the group $R^2$ is bonded to the nitrogen atom in the nitrogen-containing heterocyclic group Z and the nitrogen-containing heterocyclic group Z contains a quaternarized nitrogen atom, are especially preferably employed in this invention.

As the anionic resin binder, there can be mentioned, for example, carboxymethyl cellulose, alginic acid salts, acrylic acid/styrene copolymers, acrylic acid/acrylic acid ester copolymers, maleic acid/vinyl ether copolymers, acrylic acid/vinyl acetate copolymers, other water-soluble acrylic resins and carboxylated styrene/-butadiene rubber latices.

As suitable examples of the nonionic resin binder, there can be mentioned polyvinyl alcohol, polyvinyl acetate aqueous emulsions, partially saponified vinyl acetate resins, partially acetalized vinyl alcohol/vinyl acetate copolymers, polyvinyl chloride aqueous emulsions, vinyl chloride/vinyl acetate copolymer emulsions, ethyl cellulose, methyl cellulose, starch, cyanoethylated starch, casein, gelatin, polyvinyl pyrrolidone, polyvinylmethyl ether, polyoxyethylene, polyacrylamide, synthetic rubber aqueous latices. Of course, the nonionic resin binders that can be used in this invention are not limited to those exemplified above. Polymers containing a water-soluble hydroxyl group and/or an ether group are especially preferred as the nonionic resin binder.

As the water-soluble or moisture-adsorbing inorganic salt that can be used as the conducting agent in this invention, there can be mentioned, for example, halides of alkali metals, alkaline earth metals, zinc, aluminum and ammonium such as sodium chloride, potassium chloride, sodium bromide, potassium bromide, lithium bromide, calcium chloride, barium chloride, magnesium chloride, zinc chloride, aluminum chloride and ammonium chloride, nitrates and nitrites of alkali metals, alkaline earth metals, zinc, aluminum and ammonium such as sodium nitrate, potassium nitrate, sodium nitrite, potassium nitrite, calcium nitrate, barium nitrate, magnesium nitrate, zinc nitrate, aluminum nitrate and ammonium nitrates, sulfates, sulfites and thiosulfates of alkali metals and ammonium such as Glauber salt, potassium sulfate, ammonium sulfate and sodium thiosulfate, carbonates and bicarbonates of alkali metals and ammonium such as sodium carbonate, potassium carbonate and ammonium carbonate, and phosphorus oxyacid salts of alkali metals and ammonium such as sodium orthophosphate and sodium methaphosphate. These inorganic salts may be used singly or in the form of a mixture of two or more of them.

As other examples of the moisture-absorbing substance that can be used as the conducting agent in this invention, there can be mentioned water-soluble polyhydric alcohols such as glycerin, diethylene glycol, triethylene glycol, polyethylene glycol, sorbitol, mannitol and pentaerythritol, various surface active agents, especially cationic surface active agents such as dodecyltrimethyl ammonium chloride, tetradecyltrimethyl ammonium chloride, hexadecyltrimethyl ammonium chloride, octadecyltrimethyl ammonium chloride, coconut-alkyltrimethyl ammonium chloride, hardened beef tallow-alkyltrimethyl ammonium chloride and behenyltrimethyl ammonium chloride, particularly long chain-alkyltrimethyl ammonium chlorides, and sodium glycine and sodium pyrrolidone-carboxylate.

In this invention, a powder of a fluorine resin is incorporated in an amount of 0.1 to 20% by weight (all of "%" and "parts" are by weight unless otherwise indicated), preferably 2 to 15%, especially preferably 5 to 10%, as the solid based on the total composition into an electrically conductive binder medium comprising a binder resin and/or a conducting agent. According to this invention, by virtue of the feature that the powder of the fluorine resin is distributed predominantly in the surface portion of the electrically conductive coating layer, even if the amount of the fluorine resin incorporated is smaller than 1%, a sufficient slip characteristic can be obtained, and even if the amount of the fluorine resin incorporated is larger than 10%, excessive reduction of the electric conductivity is not caused in the electrically conductive coating layer. However, if the entire surface of the electrically conductive coating layer is completely covered with a film of the fluorine resin, when the photosensitive layer is subjected to imagewise exposure after charging, it is difficult to ground the electrically conductive coating layer. Accordingly, it is advantageous and preferred from the economical viewpoint that the fluorine resin be incorporated in a relatively small amount so that the fluorine resin is exposed in the form of dots on the surface of the electrically conductive coating layer.

In order to attain the delustering effect and impart opacity and graphic property, known fillers such as titanium dioxide, various clay products, silica, talc, calcium carbonate, magnesia, alumina, magnesium hydroxide, magnesium carbonate, calcium silicate or the like may be incorporated in the electrically conductive coating layer.

Electrically conductive coating compositions that are especially preferably used in this invention are shown in Table 1.

Table 1

| Ingredients | Amounts Incorporated (%) Preferred Range | Optimum Range |
|---|---|---|
| Binder resin | 5–20 | 2–10 |
| Conducting agent | 5–30 | 4–10 |
| Fluorine resin | 2–15 | 5–10 |
| Filler | 0–10 | 0–4 |
| Dispersant | 0–0.5 | 0–0.2 |
| Solvent | balance | balance |

In practising this invention, it is especially preferred to use as the electrically conductive binder medium a composition comprising (A) a polymeric resinous conducting agent containing a quaternary ammonium group in the main chain or side chain, (B) a nonionic resin binder and/or a weakly anionic resin binder and (C) an activating agent represented by the following formula:

$$R^1—N(R^2)_3^+ \cdot X^{31}$$

wherein $R^1$ is a long-chain alkyl group having 10 to 22 carbon atoms, $R^2$ is an alkyl group having up to 4 carbon atoms, and $X^-$ is a monovalent anion, the mixing weight ratio (A)/(B) of the polymeric resinous conducting agent (A) to the resin binder (B) being in the range of from 10/90 to 80/20 and the amount of the activating agent (C) being 5 to 100% by weight based on the sum of the polymeric resinous conducting agent (A) and the resin binder (B).

This electrically conductive binder composition has an especially high ability to distribute fine particles of a fluorine resin predominantly in the surface portion of the resulting electrically conductive coating layer. Accordingly, when this composition is used in combination with fine particles of a fluorine resin, there can be obtained a photosensitive paper especially excellent in the slip characteristic, the scratch resistance and the adaptability to the paper feeding operation. Further, the electrically conductive binder medium of the above-mentioned composition has a much more reduced dependency to the humidity in the electric conductivity than other electrically conductive binder media, and it has an especially excellent electric conductivity even under low humidity conditions. Furthermore, even under high humidity conditions, the resulting photosensitive paper has a much reduced tacking or curling tendency.

Cationic electrically conductive resins mentioned above can be used as the polymeric conducting agent (A). Any of nonionic and weakly anionic resins that are soluble or dispersible in water or a water-miscible organic solvent and that do not form a water-insoluble polysalt when combined with the above-mentioned quaternary ammonium group-containing, polymeric resinous conducting agent (A) can be used as the resin binder (B). Suitable examples of the nonionic resin binder are those exemplified hereinbefore. Resin binders free of a strongly anionic group such as a sulfonic acid group can be used as the weakly anionic resin binder. For example, there can be used carboxymethyl cellulose, alginic acid salts, acrylic acid/styrene copolymers, acrylic acid/acrylic acid ester copolymers, maleic acid/vinyl ether copolymers, acrylic acid/vinyl acetate copolymers, other water-soluble acrylic resins, and carboxylated styrene/butadiene rubber latices. In these weakly anionic resin binders, it is preferred that the concentration of the carboxyl group bonded to the main or side chain of the polymer be lower than 500 meq/100 g of the polymer, especially lower than 300 meq/100 g of the polymer.

The electrically conductive coating composition is used in the form of a solution. A paper substrate such as tissue paper, high quality paper, raw paper for a copying sheet, art paper, coated paper or the like is impregnated with such coating composition from one side, or the composition is coated on one surface of the paper substrate, to form a paper substrate having an electrically conductive coating layer on one surface thereof.

As the solvent, there may be used water and water-miscible organic solvents such as methanol, ethanol, dioxane, tetrahydrofuran, acetone, dimethylsulfamide and dimethylsulfoxide. These solvents may be used singly or in the form of a mixture of two or more of them. In general, it is preferred to use water alone or a mixture of water with a water-miscible organic solvent such as mentioned above.

When the coating composition is prepared, the above-mentioned conducting agent, resin binder and filler are uniformly dissolved or dispersed in the solvent, and fine particles of a fluorine resin in the form of a dispersion or in the dried state are uniformly dispersed in the solution or dispersion.

The solid content in the so formed coating composition is not particularly critical so far as a good dispersion state and a good adaptability to the coating operation can be obtained in combination. In general, the solid content is adjusted to 10 to 40%, preferably 20 to 30%.

The amount coated of the electrically conductive coating composition on the paper substrate is varied depending on the kind of the paper substrate and the use of the final photosensitive paper for electrophotography. In general, however, it is preferred that the amount coated of the composition be 3 to 20 g/m$^2$, especially 5 to 15 g/m$^2$, as in the dry state.

A coating composition prepared in the same manner as the above-mentioned electrically conductive coating composition except that the fluorine resin is not incorporated is preferably used for formation of the undercoat layer 3 shown in FIG. 1. The amount coated of the undercoat is preferably 2 to 15 g/m$^2$, especially 4 to 10 g/m$^2$.

In the case where the paper substrate 1 is high quality paper, tissue paper or raw paper for a copying sheet, the undercoat layer 3 should be formed, but in the case where the paper substrate 1 is art paper or coated paper, the undercoat layer 3 may be omitted.

For formation of the photoconductive layer 4, an inorganic photoconductor such as photoconductive zinc oxide or photoconductive titanium oxide or an organic photoconductive such as polyvinyl carbazole is used, if necessary in the form of a dispersion in an electrically insulating resin binder (having a volume resistivity higher than $10\times10^{14}\Omega$-cm) such as a hydrocarbon homopolymer or copolymer, e.g., polyolefin, polystyrene or a styrene/butadiene copolymer, a vinyl homopolymer or copolymer, e.g., a polyacrylic acid ester or a vinyl acetate/vinyl chloride copolymer, or a resin binder, e.g., an alkyd resin, a melamine resin or an epoxy resin. The combination and recipe of such photoconductor and resin binder are well-known, and any of known combinations and known recipes can be utilized in this invention.

A typical instance of the coating composition preferably used in this invention for formation of a photoconductive layer is as follows:

| | |
|---|---|
| Photoconductor | 100 parts |
| Electrically insulating resin binder | 15–25 parts |
| Photosensitizer | $5\times10^{-3}$ to $5\times10^{-2}$ parts |
| Solvent | 50–100 parts |

The composition is applied to the substrate or undercoat layer in the form of a solution or dispersion in an aromatic solvent such as benzene, toluene or xylene so that the amount coated is 20 to 30 g/m$^2$ as the dry solid.

This invention will now be described in detail by reference to the following Examples that by no means limit the scope of the invention.

EXAMPLE 1

A coating composition for formation of an electrically conductive layer was prepared from the following components:

| | |
|---|---|
| Electrically conductive polymer (ECR-77 manufactured by Dow Chemical; quaternary ammonium salt) | 100 g |
| Polyvinyl acetate emulsion (Movinyl 7C manufactured by Farbweke Hoechst) | 100 g |
| White pigment (Ultra-White 90 manufactured by Georgia Kaolin) | 70 g |
| Finely divided tetrafluoroethylene powder (molecular weight = about 50,000) | 50 g |
| Methanol | 600 g |

The electrically conductive polymer, polyvinyl acetate emulsion and white pigment were added into methanol as the solvent and dispersed therein by a dispersing machine equipped with an ultra-high speed agitator, and the tetrafluoroethylene resin was added and the mixture was agitated for about 5 minutes to form a homogeneous dispersion. The so prepared dispersion was applied on one surface of coated paper (Coated Paper SK manufactured by Sanyo Kokusaku Pulp; base weight=70 g/m$^2$) by a wire bar coater so that the amount coated was about 5 g/m$^2$ on the dry base, and the applied dispersion was dried to form an electrically conductive processed paper having an electrically conductive layer. Then, a photoconductive dispersion having a composition indicated below was coated on the opposite surface of the processed paper by a reverse coater so that the amount coated was about 20 g/m$^2$, and the coated dispersion was dried to form a photosensitive paper for electrostatic photography.

| Composition of Photoconductive Dispersion | |
|---|---|
| Zinc oxide | 100 g |
| Acrylic resin (FR-83 manufactured by Mitsubishi Rayon, solid content = 40%) | 50 g |
| Bromophenol Blue | 10 mg |
| Fluorescene | 10 mg |
| Toluene | 90 g |
| Methanol | 10 g |

The photoconductive dispersion used was prepared from the above ingredients by using a sand mill dispersing machine.

The obtained photosensitive paper for electrostatic photography was cut into $B_4$ size, and 200 photosensitive sheets of the photosensitive paper were set in an electrostatic copying machine (Copystar Model 500-D manufactured by Mita Industrial Co. Ltd.; provided with an automatic paper feed device). The copying operation was carried out continuously under high humidity and low humidity conditions. As a result, it was found that prints having a clear and sharp copied image were obtained without such troubles as simultaneous feeding of a plurality of sheets or non-feeding at the paper feeding step.

EXAMPLE 2

A coating composition for formation of an electrically conductive layer was prepared from the following components:

| | |
|---|---|
| Water | 600 g |
| White pigment (Aerosil 130 manufactured by Nippon Aerosil) | 50 g |
| Vinylacetate resin emulsion (Polysol 2NS manufactured by Showa Kobunshi) | 100 g |
| ECR-77 (manufactured by Dow Chemical; solid content = 33.5%) | 110 g |
| Finely divided trifluoromonochloroethylene resin | 50 g |

The pigment, vinyl acetate resin emulsion and electrically conductive polymer were dispersed in succession into water by a dispersing machine equipped with an ultra-high speed agitator, and the trifluoromonochloroethylene resin was finally added and the mixture was agitated for about 5 minutes to form a homogeneous dispersion. The dispersion was coated on the wire side of a raw paper for photosensitive sheets (50 Kg-base diazo type raw paper manufactured by Daishowa Seishi) by a wire bar coater (wire diameter=0.45 mm) so that the amount coated was about 5 g/m$^2$ on the dry basis, and the applied dispersion was dried to form an electrically conductive layer. Then, an undercoating solution (i) having a composition indicated below was coated and dried on the felt side of the electrically conductive processed paper in the same manner as described above, and the resulting processed paper was subjected to a calender treatment. Then, a photoconductive dispersion (ii) having a composition indicated below was coated by a reverse coater so that the amount coated was about 20 g/m$^2$ on the dry basis, and the applied dispersion was dried to obtain a photosensitive paper for electrostatic photography.

| (i) Undercoating Solution | |
|---|---|
| Water | 500 g |
| Ultra-White (manufactured by Georgia Kaolin) | 200 g |
| Polysol 2NS (manufactured by Showa Kobunshi) | 120 g |
| ECR-34 (manufactured by Dow Chemical) | 120 g |

The undercoating solution was prepared by uniformly agitating and dispersing the foregoing ingredients

| (ii) Photoconductive Dispersion | |
|---|---|
| Sazex 4000 (manufactured by Sakai Kagaku) | 100 g |
| Acrylic resin (FR-83 manufactured by Mitsubishi Rayon) | 50 g |
| Bromophenol Blue | 10 mg |
| Fluorescene | 10 mg |
| Methanol | 10 g |
| Toluene | 90 g |

The above components were uniformly dispersed by means of a sand mill dispersing machine.

The so obtained photosensitive paper was cut into $B_4$ size, and 200 sheets of the photosensitive paper were set in an electrostatic copying machine (Copystar Model 500D manufactured by Mita Industrial Co. Ltd.; provided with an automatic paper feed device). The copying operation was carried out continuously under high humidity and low humidity conditions. As a result, it was found that prints having a clear and sharp copied image could be obtained stably without any trouble in the paper feeding operation.

EXAMPLE 3

In the same manner as described in Example 2, an electrically conductive coating composition was prepared from the following components:

| | |
|---|---|
| Water | 100 g |
| Methanol | 500 g |
| Talc (High-Filler manufactured by Matsumura Sangyo) | 70 g |
| Movinyl DV (manufactured by Farbwerke Hoechst) | 100 g |
| Finely divided vinylidene fluoride resin | 50 g |

The so formed composition was coated and dried in the same manner as described in Example 2 to form an electrically conductive processed paper. In the same manner as described in Example 2, the same undercoating solution and photoconductive composition as used in Example 2 were coated and dried on the electrically conductive processed paper to obtain a photosensitive paper for electrostatic photography. By using the so obtained photosensitive paper, the copying operation was carried out in the same manner as described in Example 2. It was found that the obtained results were as good as the results obtained in Example 2.

EXAMPLE 4

A photosensitive paper for electrostatic photography was prepared in the same manner as described in Example 2 except that 60 g of a finely divided vinyl fluoride resin was used instead of 50 g of the finely divided trifluoromonochloroethylene resin for formation of the electrically conductive coating composition. In the same manner as described in Example 2, the copying operation was carried out by using the so prepared photosensitive paper. It was found that the obtained results were as good as the results obtained in Example 2.

EXAMPLE 5

In the same manner as described in Example 1, an electrically conductive coating composition was prepared from the following components:

| | |
|---|---|
| Methanol | 300 g |
| Siloyd 244 ($SiO_2$ manufactured by Fuji-Davison) | 10 g |
| Vinyl acetate resin (methanol solution; solid content = 48%) | 80 g |
| ECR-77 (manufactured by Dow Chemical) | 55 g |
| Trifluoroethylene/hexafluoropropylene copolymer resin fine powder | 40 g |

In the same manner as described in Example 1, an electrically conductive processed paper was prepared by using the so obtained coating composition. Then, in the same manner as described in Example 1, a photosensitive paper for electrostatic photography was prepared by using the so prepared electrically conductive paper and the same photoconductive dispersion as used in Example 1. When the copying operation was carried out by using the so prepared photosensitive paper in the same manner as described in Example 1, it was found that the obtained results were as good as the results obtained in Example 1.

EXAMPLE 6

In the same manner as described in Example 1, an electrically conductive coating composition was prepared from the following components:

| | |
|---|---|
| Methanol | 600 g |
| Talc (Micro-Ace manufactured by Nippon Talc) | 100 g |
| Vinyl acetate resin (methanol solution; solid content = 48%) | 100 g |
| Chemistat 6200 (manufactured by Sanyo Kasei; solid content = 50%) | 150 g |
| Finely divided tetrafluoroethylene resin | 60 g |

An electrically conductive processed paper was prepared by using the so prepared electrically conductive coating solution in the same manner as described in Example 1. Then, the same photoconductive dispersion as used in Example 1 was coated and dried on the so prepared electrically conductive processed paper in the same manner as described in Example 1 to obtain a photosensitive paper for electrostatic photography. In the same manner as described in Example 1, the copying operation was carried out by using the so prepared photosensitive paper. It was found that the obtained results were as good as the results obtained in Example 1.

EXAMPLE 7

In the same manner as described in Example 1, an electrically conductive coating solution was prepared from the following components:

| | |
|---|---|
| Methanol | 600 g |
| Vinyl acetate resin (methanol solution; solid content = 48%) | 100 g |
| ECR-77 (manufactured by Dow Chemical) | 150 g |
| Tetrafluoroethylene resin | 80 g |

In the same manner as described in Example 1, an electrically conductive processed paper was prepared by using the so prepared coating composition. Then, the same photoconductive dispersion as used in Example 1 was coated on the electrically conductive processed paper in the same manner as described in Example 1 to obtain a photosensitive paper for electrostatic photography. When the copying operation was carried out in the same manner as described in Example 1 by using the so prepared photosensitive paper, it was found that the obtained results were as good as the results obtained in Example 1.

EXAMPLE 8

An electrically conductive coating composition was prepared from the following components:

| | |
|---|---|
| Electrically conductive polymer (ECR-77 manufactured by Dow Chemical; quaternary ammonium salt) | 100 g |
| Polyvinyl acetate emulsion (Movinyl 7C manufactured by Farbwerke Hoechst) | 100 g |
| White pigment (Ultra-White 90 manufactured by Georgia Kaolin) | 70 g |
| Dodecyltrimethyl ammonium chloride | 80 g |
| Finely divided tetrafluoroethylene resin (molecular weight = about 50,000) | 50 g |
| Methanol | 600 g |

The above components other than the tetrafluoroethylene resin were successively added into methanol as the solvent and dispersed therein by means of a dispersing machine equipped with an ultra-high speed agitator, and the tetrafluoroethylene resin was finally added to the dispersion and the mixture was agitated for about 5 minutes to obtain a homogeneous dispersion. The so obtained dispersion was coated on one surface of a coated paper having a base weight of 70 g/m$^2$ (Coated Paper SK manufactured by Sanyo Kokusaku Pulp) by means of a wire bar coater (wire diameter=0.45 mm) so that the amount coated was about 5 g/m$^2$ on the dry base. The coated composition was then dried to form an electrically conductive processed paper having an electrically conductive coating layer. A photoconductive dispersion having a composition indicated below was coated on the opposite surface of the electrically conductive processed paper by means of a reverse coater so that the amount coated was about 20 g/m$^2$, and the applied dispersion was dried to obtain a photosensitive paper for electrostatic photography. The photosensitive paper was cut into $B_4$ size, and 200 sheets of the photosensitive paper were set in an electrostatic copying machine equipped with an automatic paper feed device (Copystar Model 500-D manufactured by Mita Industrial Co. Ltd.) and the copying operation was carried out continuously under high humidity and low humidity conditions. Prints having a clear and sharp copied image were obtained without occurrence of any trouble in the paper feeding operation.

| Photoconductive Dispersion | |
|---|---|
| Zinc oxide | 100 g |
| Acrylic resin (FR-83 manufactured by Mitsubishi Rayon; solid content = 40%) | 50 g |
| Bromophenol Blue | 10 mg |
| Fluorescene | 90 g |
| Methanol | 10 g |

The photoconductive dispersion was prepared from the above components by using a sand mill dispersing machine.

EXAMPLE 9

An undercoating composition was prepared from the following components by agitating and dispersing them in a dispersing machine equipped with a high speed agitator:

| | |
|---|---|
| Water | 580 g |
| Ultra-White 90 (manufactured by Georgia Kaolin) | 200 g |
| Polysol 2NS (manufactured by Showa Kobunshi; solid content = 50%) | 160 g |
| ECR-34 (manufactured by Dow Chemical; solid content = 33.5%) | 60 g |

The under coating composition was coated on the felt side of a raw paper for photosensitive sheets (50 Kg-base diazo paper manufactured by Daishowa Seishi) so that the amount coated was 7 to 10 g/m$^2$ on the dry base, and the applied composition was dried.

An electrically conductive coating composition was prepared from the following components by agitating and dispersing them in a dispersing machine equipped with a high speed agitator:

| | |
|---|---|
| Water | 493 g |
| Ultra-White 90 | 200 g |
| Polysol 2NS (solid content = 50%) | 120 g |
| ECR-34 (solid content = 33.5%) | 120 g |
| Octadecyltrimethyl ammonium chloride | 67 g |
| Finely divided trifluoromonochloroethylene resin | 50 g |

The so prepared coating composition was coated on the opposite surface (wire side) of the undercoated paper so that the amount coated was 6 to 8 g/m$^2$ on the dry base, and the applied composition was dried to form an electrically conductive processed paper. Then, a photoconductive composition indicated below was coated on the undercoat-formed surface of the processed paper so that the amount coated was 15–20 g/m$^2$ on the dry base, and the applied composition was dried to obtain a photosensitive paper for electrostatic photography.

| Photoconductive Composition | |
|---|---|
| Sazex 4000 (manufactured by Sakai Kagaku) | 100 g |
| FR-83 (manufactured by Mitsubishi Rayon; solid content = 40%) | 50 g |
| Bromophenol Blue | 10 mg |
| Fluorescene | 10 mg |
| Toluene | 90 g |
| Methanol | 10 g |

The so prepared photosensitive paper was cut into $B_4$ size and 200 sheets of the photosensitive paper were set at an electrostatic copying machine provided with an automatic paper feed device (Copystar Model 500-D manufactured by Mita Industrial Co. Ltd.). The copying operation was carried out continuously under high humidity and low humidity conditions. Prints having a clear and sharp copied image free of fog were obtained without occurrence of any trouble in the paper feeding operation.

What we claim is:

1. A photosensitive paper for electrophotography which comprises a paper substrate, an electrophotographic photosensitive layer formed on one surface of the paper substrate and an electrically conductive coating layer formed on the other surface of the paper substrate, said electrically conductive coating layer comprising an electrically conductive binder medium and from 0.1 to 20% by weight based on the entire binder medium of a fine powder of a fluorine resin having a particle size of 0.5 to 10$\mu$ distributed predominantly in the surface portion of said electrically conductive coating layer.

2. A photosensitive paper as set forth in claim 1 wherein the fluorine resin has an average molecular weight of 10,000 to 300,000.

3. A photosensitive paper as set forth in claim 1 wherein the fluorine resin is a tetrafluoroethylene resin or trifluoromonochloroethylene resin.

4. A photosensitive paper as set forth in claim 1 wherein said electrically conductive binder medium is a medium comprising an electrically conductive resin.

5. A photosensitive paper as set forth in claim 4 wherein the electrically conductive resin contains a quaternary ammonium group in the main chain or side chain at a concentration of 200 to 1000 milliequivalents per 100 g of the resin.

6. A photosensitive paper as set forth in claim 1 wherein the electrically conductive binder medium comprises a binder resin and a conducting agent.

7. A photosensitive paper as set forth in claim 1 wherein an undercoat layer is formed between the paper substrate and the electrophotographic photosensitive layer.

8. A photosensitive paper as set forth in claim 1 wherein the electrically conductive binder medium is a composition comprising (A) a polymeric resinous conducting agent containing a quaternary ammonium group in the main chain or side chain, (B) a nonionic resin binder and/or a weakly anionic resin binder and (C) an activating agent represented by the following formula:

$$R^1—N(R^2)_3{}^+X^-$$

wherein $R^1$ is a long-chain alkyl group having 10 to 22 carbon atoms, $R^2$ is an alkyl group having up to 4 carbon atoms, and $X^-$ is a monovalent anion, the mixing weight ratio (A)/(B) of the polymeric resinous conducting agent (A) to the resin (B) being in the range of from 10/90 to 80/20 and the amount of the activating agent (C) being 5 to 100% by weight based on the sum of the polymeric resinous conducting agent (A) and the resinous binder (B).

9. A photosensitive paper as set forth in claim 8 wherein said activating agent (C) is a long-chain-alkyltrimethyl ammonium chloride.

10. A photosensitive paper as set forth in claim 8 wherein said binder (B) is polyvinyl alcohol, partially saponified polyvinyl acetate, acetalized polyvinyl alcohol or an acetalized vinyl alcohol/vinyl acetate copolymer.

* * * * *